United States Patent [19]

Aquino et al.

[11] Patent Number: 4,604,105

[45] Date of Patent: Aug. 5, 1986

[54] FLUIDIZED BED GASIFICATION OF EXTRACTED COAL

[75] Inventors: Dolores C. Aquino, Houston, Tex.; Philip L. DaPrato, Westfield, N.J.; Toby R. Gouker, Baton Rouge, La.; Peter Knoer, Houston, Tex.

[73] Assignee: The United States of America as represented by the United States Department of Energy, Washington, D.C.

[21] Appl. No.: 628,079

[22] Filed: Jul. 6, 1984

[30] Foreign Application Priority Data

Aug. 24, 1983 [EP] European Pat. Off. ..... 68757

[51] Int. Cl.[4] ..... C10J 3/54

[52] U.S. Cl. ..... 48/197 R; 48/202; 48/210

[58] Field of Search ..... 48/197 R, 202, 206, 48/210, DIG. 7; 201/17, 9; 44/1 R, 1 A, 1 B, 1 G; 208/8 LE, 9; 252/373

[56] References Cited

U.S. PATENT DOCUMENTS

| | | | |
|---|---|---|---|
| 4,052,168 | 10/1977 | Koppelman | 44/1 G |
| 4,084,938 | 4/1978 | Willard, Sr. | 44/1 R |
| 4,092,125 | 5/1978 | Stambaugh et al. | 44/1 R |
| 4,219,338 | 8/1980 | Wolfs et al. | 48/197 R |
| 4,234,319 | 11/1980 | Beeson | 44/1 R |
| 4,280,817 | 7/1981 | Chauhan et al. | 44/1 R |
| 4,284,416 | 8/1981 | Nahas | 48/197 R |
| 4,336,034 | 6/1982 | Lang et al. | 48/202 |
| 4,432,773 | 2/1984 | Euker, Jr. et al. | 48/197 R |
| 4,459,138 | 7/1984 | Soung | 48/197 R |

OTHER PUBLICATIONS

*Chemistry of Coal Utilization*, "The Plastic Properties of Coal", Loison et al., Supplementary Volume, p. 188, (1963).

Solvent Extract and the Plastic Properties of Coal, by E. D. Pierron et al, Division of the Illinois State Geological Survey Circular 288, 1960.

*Primary Examiner*—Barry S. Richman
*Assistant Examiner*—Joye L. Woodard
*Attorney, Agent, or Firm*—Anne Dickson Daniel; Judson R. Hightower

[57] ABSTRACT

Coal or similar carbonaceous solids are extracted by contacting the solids in an extraction zone (12) with an aqueous solution having a pH above 12.0 at a temperature between 65° C. and 110° C. for a period of time sufficient to remove bitumens from the coal into said aqueous solution and the extracted solids are then gasified at an elevated pressure and temperature in a fluidized bed gasification zone (60) wherein the density of the fluidized bed is maintained at a value above 160 kg/m$^3$. In a preferred embodiment of the invention, water is removed from the aqueous solution in order to redeposit the extracted bitumens onto the solids prior to the gasification step.

10 Claims, 2 Drawing Figures

FLUIDIZED BED GASIFICATION OF EXTRACTED COAL

BACKGROUND OF THE INVENTION

This invention relates to the gasification of coal and similar carbonaceous solids and is particularly concerned with a method for maintaining a relatively high gasifier bed density in a fluidized bed gasification process.

The formation of agglomerates is a problem frequently encountered in the gasification of caking coals. This is caused by plastic properties which develop when such coals are subjected to temperatures above their softening point. Upon reaching this point, generally between about 370° C. and about 480° C., the coal particles begin to swell and then deform due to the formation of bubbles during devolatilization. As the temperature increases, deformation becomes more severe, the coal becomes plastic and sticky, and may eventually become fragile. The sticky particles tend to agglomerate and form coherent solid masses which reduce gas permeability and tend to block the reactor and the reactor feed lines.

Several methods have been devised to alleviate agglomeration problems encountered when caking bituminous coals are gasified. One such method proposed in the past is to pretreat the raw coal by contacting it with air at relatively high temperatures prior to passing the coal into the gasification reactor. Past studies have indicated that treatment of raw coal in such a fashion tends to destroy its caking properties and thereby prevents it from agglomerating during gasification. It has been noted that such pretreatment procedures have pronounced disadvantages in that they are either expensive, result in the loss of valuable volatile constituents from the coal or reduce the amount of methane that can be produced from a given amount of coal. Thus, these pretreatment procedures are undesirable for use in a gasification process. In lieu of pretreating raw coal with air at high temperatures, it has been suggested in the past that coal be treated with a dilute aqueous solution of sodium hydroxide at room temperature in order to decake the coal. Past studies have shown that raw coal treated with aqueous solutions of sodium hydroxide exhibit a free-swelling index in the range from about 1 to 2 and is therefore relatively noncaking at atmospheric pressure.

Because of past teachings that sodium hydroxide tends to decake coal, it was felt that agglomeration would not be a problem in catalytic gasification of caking coals if the alkali metal catalyst was added to the raw coal prior to introduction of the coal into the gasifier. Indeed, it has been found in the past that when coal is impregnated with alkali metal compounds and gasified in a fluidized bed at relatively low pressures, agglomeration problems are substantially obviated. It has now been surprisingly discovered, however, that when fluidized bed catalytic gasification is carried out at higher pressures, the density of the resultant fluidized bed of char particles is very low, in some instances as low as 80 kg/m$^3$. Such low bed densities result in a substantial reduction in the amount of coal that can be processed in a given gasifier and therefore substantially decrease the amount of product gas that can be produced in the process. In order to convert more coal into gas per unit of time, it would be necessary to utilize a much larger gasifier or to employ multiple gasifiers, procedures that would result in a substantial increase in the investment cost of a commercial plant and the resulting price of the product gas.

SUMMARY OF THE INVENTION

The present invention provides an improved fluidized bed coal gasification process which results in the maintenance of a relatively high fluidized bed density in the gasification reactor. In accordance with the invention, it has now been found that relatively high fluidized bed densities, normally densities above about 160 kg/m$^3$, can be maintained in a gasifier operating at elevated pressure and temperature by contacting the carbonaceous feed solids in an extraction zone with an aqueous solution having a pH above about 12.0 at a temperature between about 65° C. and about 110° C. for a period of time sufficient to extract bitumens from the solids prior to the gasification step. The aqueous solution will preferably contain a water-soluble compound possessing catalytic gasification activity which is deposited onto the solids during the extraction step and thereafter serves as a steam gasification catalyst during the gasification of the carbonaceous solids. The aqueous solution may be the solution obtained by leaching the particles produced in the gasification zone. These particles contain catalyst constituents which can be recovered for reuse by leaching the solids with water. Normally, the aqueous solution will be a solution of an alkali metal hydroxide, preferably a solution containing potassium hydroxide.

In a preferred embodiment of the invention, the bitumens extracted from the carbonaceous feed solids are redeposited onto the solids by removing water from the aqueous solution while it is in contact with the extracted solids in order to dry the solids prior to the gasification step. Preferably, the water is removed by flash drying the slurry effluent from the extraction zone. In an alternative embodiment of the invention, the aqueous solution is separated from the carbonaceous solids in the slurry effluent from the extraction zone, concentrated by removing a portion of the water and recombined with the solids to form a mixture from which the water is then removed to dry the carbonaceous solids and redeposit the extracted bitumens onto the solids prior to gasification. In both of the above embodiments of the invention, the carbonaceous solids containing the redeposited bitumens are gasified at an elevated pressure and temperature in a fluidized bed gasification zone wherein the density of the fluidized bed is maintained at a value above about 160 kg/m$^3$.

The invention is based at least in part upon the discovery that bituminous coals containing an impregnated alkali metal catalyst yield relatively low fluidized bed densities during gasification at elevated pressure as opposed to relatively high densities that had been found in the past when gasification was carried out at relatively low pressures. Laboratory studies designed to predict bed density by measuring the swelling tendencies of coal under pressure indicate that coal containing alkali metal catalyst constituents swells when subjected to rapidly increasing temperature at the high pressures that are found in typical high pressure gasification reactors. These laboratory studies also show that the swelling tendencies are dramatically reduced when the coal is first extracted with a high pH solution to remove bitumens. The studies further indicate that the bitumens can be redeposited onto the coal after the extraction step without deleteriously affecting the relatively high bed densities obtained during subsequent gasification.

The process of the invention provides an efficient method for the fluidized bed gasification of bituminous coals and similar carbonaceous solids that tend to agglomerate and swell at elevated temperatures and high pressures, which results in relatively high densities in the fluidized bed. As a result of the higher bed densities, more coal and product gas can be produced for a given size gasifier thus resulting in substantial savings especially when compared to the case where a larger gasifier or multiple gasifiers would be required in order to compensate for low bed densities.

DESCRIPTION OF THE PREFERRED EMBODIMENTS

Figure 1:
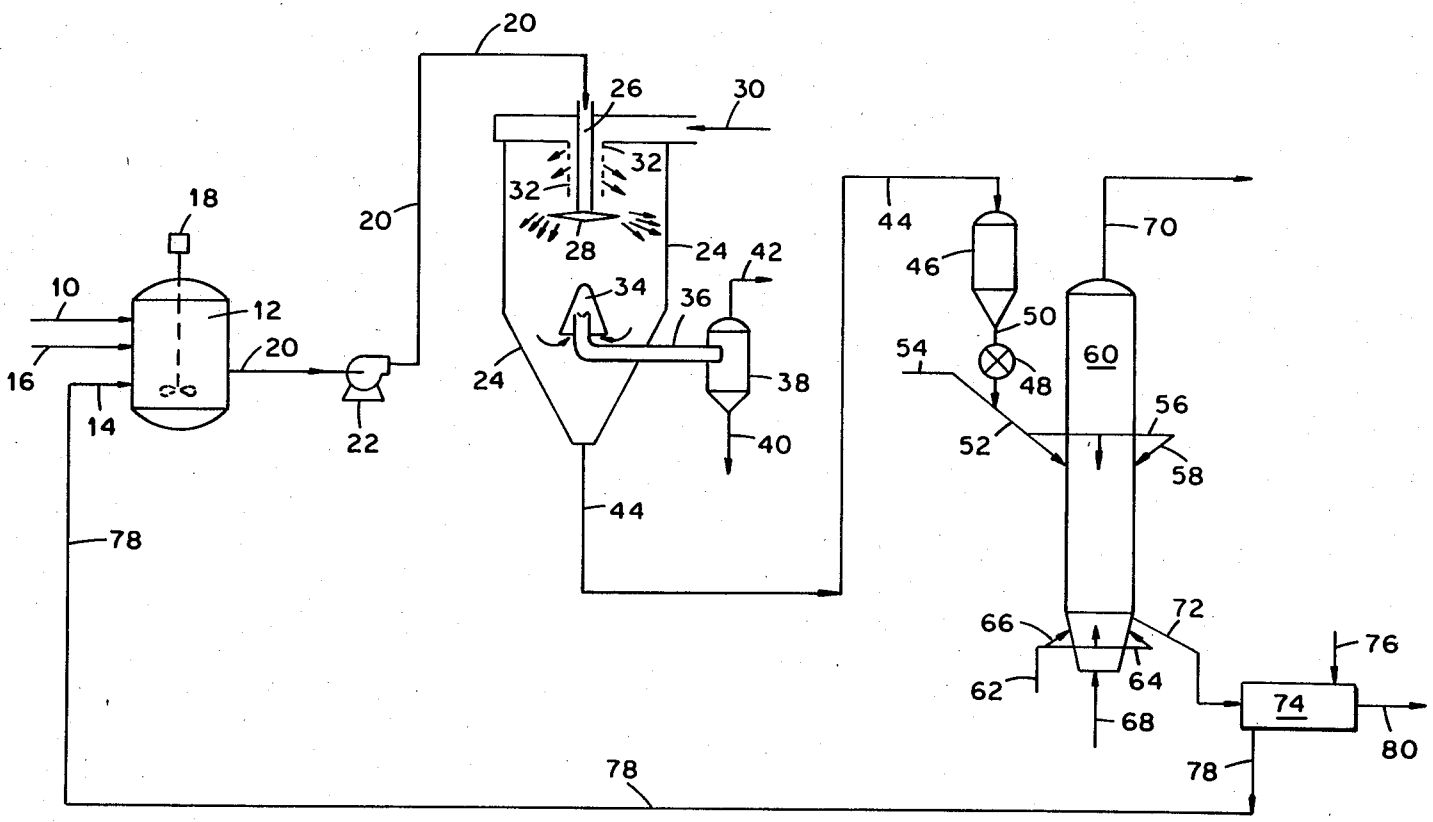
FIG. 1 is a schematic flow diagram of a fluidized bed coal gasification process carried out in accordance with one embodiment of the invention.

The process depicted in FIG. 1 is one for the production of a substitute natural gas by the fluidized bed catalytic gasification of bituminous coal, subbituminous coal, lignite, liquefaction bottoms or other carbonaceous solids which contain volatilizable hydrocarbon constituents and may tend to swell and agglomerate at elevated temperatures. It will be understood that the invention is not restricted to this particular gasification process and instead may be employed in any fluidized bed gasification operation, whether or not a catalyst is employed, to promote the reaction of oxygen, steam, hydrogen, carbon dioxide, or a similar gasification agent with solid carbonaceous feed material in a fluidized bed gasification reactor operated at elevated pressures.

In the process shown in FIG. 1, the solid carbonaceous feed material that has been crushed to a particle size of about 8 mesh or smaller on the U.S. Sieve Series Scale is passed into line 10 from a feed preparation plant or storage facility that is not shown in the drawing. The solids introduced into line 10 are fed into slurry tank or similar vessel 12 where they are mixed with an aqueous solution of a water-soluble catalyst introduced into the slurry tank through line 14. The catalyst-containing solution is recycled through line 78 from the catalyst recovery portion of the process, which is described in more detail hereinafter. Normally, the water-soluble catalyst will be an alkali metal salt active in promoting the steam gasification of coal and similar carbonaceous materials and will be present in sufficient concentration to yield a pH greater than 12. Preferably, the water-soluble catalyst will be an alkali metal hydroxide such as potassium hydroxide or a combination of an alkali metal hydroxide with an alkali metal salt such as potassium carbonate. The aqueous solution introduced through line 14 will normally contain between about 2.0 weight percent and about 50.0 weight percent, preferably between about 15.0 weight percent and 45.0 weight percent, of water-soluble catalyst. Normally, a sufficient amount of the aqueous solution is introduced into slurry tank 12 such that the solids concentration in the resultant slurry is between about 10 weight percent and about 70 weight percent, preferably between about 30 weight percent and about 60 weight percent. If there is not a sufficient amount of aqueous solution available from the catalyst recovery portion of the process to obtain the desired pH or solids concentration, makeup solution, normally a pure alkali metal hydroxide, may be introduced into the slurry tank through line 16.

The aqueous slurry of carbonaceous solids formed in tank 12, which will have a pH greater than about 12.0, is agitated by means of stirrer 18 at a temperature between about 65° C. and about 110° C., preferably between about 90° C. and about 105° C. This agitation is continued for a sufficient period of time to extract bitumens, the lower molecular weight hydrocarbons in the carbonaceous feed material that tend to be soluble in conventional organic solvents, from the solids into the aqueous solution. The required residence time of the slurry in tank 12 will depend upon the pH of the aqueous portion of the slurry formed in the tank 12 and the temperature at which the extraction is carried out. The pH of the aqueous solution will normally be above 12.0 and preferably above about 13.5. For most feed materials, the residence time of the slurry in tank 12 will be greater than about 15.0 minutes and will preferably range between about 30 minutes and about 90 minutes. During the extraction step, the tank 12 will normally be maintained at atmospheric pressure.

In conventional catalytic gasification processes, the catalyst is impregnated onto the solids by spraying an aqueous solution of the catalyst onto the solid feed material to be gasified and then drying the wetted solids to impregnate the catalyst. It has been found that when solids impregnated with a catalyst in this manner are gasified in a fluidized bed gasifier operated at relatively high pressure, normally above about 0.35 MPa and preferably above about 0.7 MPa, the density of the fluidized bed is very low. This, in turn, results in the need for a larger gasifier in order to produce the desired quantities of product gas. It has now been found that the density of the fluidized bed in the gasifier can be substantially increased thereby obviating the need for a larger gasifier by extracting bitumens from the solids prior to gasification. The bitumens in coal apparently act as plasticizers and when the coal is rapidly heated at high pressures, it will have a tendency to swell. If, however, the bitumens are extracted from coal prior to gasification it has been found that swelling and density in a fluidized bed can be controlled. Unfortunately, if organic material is removed from the coal prior to gasification, the efficiency of the process is reduced because of the lost organic material that could otherwise be converted in the gasifier. It has further been found that the extracted bitumens can be redeposited onto the extracted coal or other carbonaceous feed material by drying the slurry effluent from the extraction step without detrimentally altering the swelling characteristics of the extracted coal during gasification. Evidently, the extraction step removes bitumens from deep within the central portion of the feed particles while drying redeposits the bitumens on the surface of the particles thereby reducing the swelling tendency of the feed particles.

Referring again to FIG. 1, the slurry effluent from tank 12, which contains the extracted carbonaceous feed solids and the aqueous solution of water-soluble gasification catalyst having a pH above 12.0 into which bitumens have been extracted, is passed through line 20 via pump 22 into spray dryer 24. The slurry is introduced into the top of the spray dryer through feed tube 26 and distributed into the dryer by spray disk 28. The dispersed slurry is contacted with a hot flue gas introduced into the dryer through line 30 and distributed into the top of the dryer through openings 32.

Within the spray dryer 24, the slurry of carbonaceous solids is introduced into the hot flue gas to form a highly dispersed liquid state in a high temperature gas zone. The hot flue gas is normally at a temperature sufficiently high to convert between about 90 and about 99 weight percent of the water in the slurry into steam. Since the hot flue gas introduced into the dryer is at a substantially higher temperature than the temperature maintained in the dryer, the sensible heat in the flue gas will vaporize a substantial portion of the water in the aqueous slurry. As the water in the feed slurry is converted into steam in the dryer, the water-soluble catalyst and the extracted bitumens are simultaneously impregnated onto the dry carbonaceous solids that were part of the slurry fed to the dryer. The spray dryer is normally operated so that the dry solids produced contain between about 0.1 weight percent and about 10.0 weight percent water.

The gas leaving the slurry dryer 24 is comprised primarily of a mixture of flue gas and steam but may also contain gaseous impurities produced by devolatilization of the carbonaceous solids under the operating conditions in the dryer. The mixture of gases passes into hood 34 where it is collected and evaluated through line 36 into cyclone separator or similar device 38. Here the fine particulates are removed from the gases through dipleg 40 while the gases are withdrawn overhead through line 42.

The dried carbonaceous solids produced in the spray dryer 24 are withdrawn from the dryer through line 44. These solids contain redeposited bitumens and are impregnated with a catalyst that possesses steam gasification activity. It will be understood that the redeposition of the bitumens and the impregnation of the catalyst can be carried out in dryers other than the spray dryer described above. In general, any type of flash drying will satisfactorily redeposit the bitumens on the surface of the carbonaceous solids while impregnating the solids with the catalyst constituents. Any device in which the feed slurry is dispersed into a hot gas zone and dried rather rapidly can be used.

The dry solids removed from spray dryer 24 through line 44, which contain redeposited bitumens and impregnated catalyst constituents, are passed to closed hopper or similar vessel 46 from which they are discharged through a star wheel feeder or equivalent device 48 in line 50 at an elevated pressure sufficient to permit their entrainment into a stream of high pressure steam, recycled product gas, inert gas or other carrier gas introduced into line 52 via line 54. The carrier gas and entrained solids are passed through line 52 into manifold 56 and fed from the manifold through lines 58 and nozzles, not shown in the drawing, into gasifier 60. In lieu of or in addition to hopper 46 and star wheel feeder 48, the feed system may employ parallel lockhoppers, pressurized hoppers, aerated standpipes operated in series, or other apparatus to raise the input feed solids stream to the required pressure level.

Gasifier 60 comprises a refractory lined vessel containing a fluidized bed of carbonaceous solids extending upward in the vessel above an internal grid or similar distribution device not shown in the drawing. The bed is maintained in the fluidized state by means of steam introduced through line 62, manifold 64 and peripherally spaced injection lines and nozzles 66, and by means of recycled hydrogen and carbon monoxide introduced through bottom inlet line 68. The particular injection system shown in the drawing is not critical, hence other methods for injecting the steam and hydrogen and carbon monoxide may be employed. In some instances, for example, it may be preferred to introduce both the steam and recycled gases through multiple nozzles to obtain a more uniform distribution of the injected fluid and reduce the possibility of channeling and related problems.

The steam introduced into the gasifier reacts with carbon in the feed material in the fluidized bed in gasifier 60 at a temperature within the range between about 425° C. and about 870° C., preferably between about 600° C. and about 760° C., and at a pressure normally above 0.7 MPa. The pressure will normally range between about 1.4 MPa and about 4.9 MPa and will preferably be between about 2.8 MPa and about 4.2 MPa. When the catalyst constituents utilized to impregnate carbonaceous feed material in spray dryer 24 comprise alkali metal constituents, these constituents will interact at the gasification temperature with carbon in the carbonaceous solids to form a carbon-alkali metal catalyst, which will under proper conditions equilibrate the gas phase reactions occurring during gasification. Due to the gas phase equilibrium conditions existing in the bed as a result of the presence of the carbon-alkali metal catalyst and the recycle hydrogen and carbon monoxide introduced near the lower end of the bed, the net reaction products will normally consist essentially of methane and carbon dioxide. Competing reactions that in the absence of catalyst and the hydrogen and carbon monoxide would ordinarily tend to produce additional hydrogen and carbon monoxide are suppressed. At the same time, substantial quantities of exothermic heat are released as a result of the reaction of hydrogen with carbon monoxide, the reaction of carbon monoxide with steam and the reaction of hydrogen with carbon. This exothermic heat tends to balance the endothermic heat consumed by the reaction of steam with carbon, thereby producing an overall reaction which is essentially thermoneutral. So far as the heat of reaction is concerned, the gasifier is therefore largely in heat balance. The heat employed to preheat the feed solids to reaction temperature and compensate for heat loss from the gasifier is supplied for the most part by excess heat in the gases introduced into the gasifier through lines 66 and 68. Such a gasification system is described in detail in U.S. Pat. Nos. 4,094,650 and 4,198,204, the disclosures of which are hereby incorporated by reference. It will be understood that the process of the invention is not limited to this type of a gasification system and can be used with any type of gasification reactor in which a fluidized bed is maintained at elevated pressures. For example, the process of the invention may employ a catalytic gasifier in which oxygen is introduced into the gasifier to burn a portion of the carbonaceous material in the fluidized bed to generate the heat required to maintain the reactor in heat balance.

The gas leaving the fluidized bed in gasifier 60 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 70 will normally contain methane, carbon dioxide, hydrogen, carbon monoxide, unreacted steam, hydrogen sulfide, ammonia and other contaminants formed from the sulfur and nitrogen contained in the feed material, and entrained fines. This gas is introduced into a cyclone separator or similar device, not shown in the drawing, for removal of fine particulates. The resulting raw product gas may then be passed through suitable heat exchange equipment for the recovery of heat and then processed for the removal of acid gases. Once this has been accomplished, the remaining gas, consisting primarily of methane, hydrogen and carbon monoxide, may be cryogenically separated into a product methane stream and a recycle stream of hydrogen and carbon monoxide which is returned to the gasifier through line 68. Conventional gas processing equipment can be used. Since a detailed description of this downstream gas processing portion of the process is not necessary for an understanding of the invention, it has been omitted.

In order to produce a reasonable amount of product methane in gasifier 44, it is necessary to maintain the fluidized bed in the gasifier at a density above about 160 $kg/m^3$. It is not fully understood why higher pressures tend to yield lower bed densities when catalyst impregnated coal or similar carbonaceous solids are gasified. It is presently believed that higher gasification pressures tend to retard the vaporization of liquids from the particles comprising the fluidized bed and this in turn softens the particles and makes them more amenable to swelling by escaping gases. It is presently believed that extracting bitumens from the carbonaceous solids prior to gasification and either discarding them or redepositing them onto the surface of the extracted solids will reduce the amount of liquids that must escape from the interiors of the particles being gasified and thereby decrease the particle softening which in turn reduced the particle swelling and results in higher fluidized bed densities.

Referring again to FIG. 1, char particles containing carbonaceous material, ash and catalyst residues are continuously withdrawn through line 72 from the bottom of the fluidized bed in gasifier 60 in order to control the ash content of the system and to permit the recovery and recycle of catalyst constituents. The withdrawn solids are passed to catalyst recovery unit 74, which will normally comprise a multistage, countercurrent leaching system in which the char particles are countercurrently contacted with fresh water or some other aqueous solution introduced through line 76. If the catalyst utilized in the process is comprised of alkali metal constituents, the first stage of the catalyst recovery unit may utilize calcium hydroxide digestion to convert water-insoluble catalyst constituents into water-soluble constituents. Such a digestion process is described in detail in U.S. Pat. No. 4,219,338, the disclosure of which is hereby incorporated by reference. An aqueous solution of water-soluble catalyst constituents is withdrawn from the recovery unit through line 78 and may be recycled through line 14 to slurry tank 12. Normally, the water-soluble catalyst constituents in the aqueous solution will comprise alkali metal constituents such as alkali metal carbonates, bicarbonates, hydroxides and similar alkali metal salts active in promoting the steam gasification of coal and similar carbonaceous solids. In most cases, the aqueous solution will be comprised primarily of a mixture of alkali metal hydroxides and alkali metal carbonates. If there is a substantial amount of the alkali metal carbonate in the solution, the pH may not be above 12.0, which is the minimum pH required in slurry tank 12 to accomplish the extraction of bitumens from the carbonaceous feed solids. If the ratio of potassium hydroxide to potassium carbonate is such that the pH of the recycle solution in line 78 is below 12.0, makeup alkali metal hydroxide can be introduced into slurry tank 12 through line 16 in order to increase the pH of the aqueous solution to a value above 12.0. Alternatively, a portion of the potassium carbonate can be converted into potassium hydroxide by contacting the recycle solution with lime or by some other method. Particles from which substantially all the soluble catalyst constituents have been extracted are withdrawn from the catalyst recovery unit through line 80 and may be disposed of as landfill or used for other purposes.

In the embodiment of the invention shown in FIG. 1 and described above, carbonaceous solids are contacted with an aqueous solution having a pH above 12.0 and containing water-soluble gasification catalyst constituents in order to extract bitumens from the solids. The slurry effluent from the extraction step is then subjected to flash drying in a spray dryer such that the water in the slurry is converted to steam simultaneously with the redeposition of the bitumens onto the solids and the impregnation of the solids with the water-soluble gasification catalyst constituents. It will be understood that the bitumens can be redeposited onto the solids via methods different from those shown in FIG. 1. No matter what method is used to redeposit the bitumens it will involve removing water to dry the solids while simultaneously redepositing the bitumens and impregnating the solids with the catalyst constituents.

An example of an alternative method of accomplishing the redeposition of bitumens and the catalyst impregnation involves passing the slurry effluent from tank 12 through a filter or other solid-liquid separation device in order to remove the aqueous portion of the slurry from the solids. The removed aqueous solution is then passed into an evaporator or similar concentrator where it is heated to vaporize some of the water and thereby concentrate the solution. The concentrated solution is then recombined with the solids exiting the solids-liquid separation device and mixed together in a blender to form a concentrated slurry or thick paste. The thick paste is then passed into a conventional moving bed dryer where it is contacted with a hot inert gas in order to remove water from the concentrated slurry and to redeposit the bitumens and impregnate the catalyst constituents. The resultant dried solids are then passed to gasifier 60 in the same manner as is shown in FIG. 1. If the pH of the recovered catalyst solution is below 12.0, a portion of the concentrated solution from the evaporator or concentrator may be recycled to the extraction zone in tank 12 to provide the appropriate pH level. It is postulated that at least some of the low molecular bitumens in the aqueous slurry leaving slurry tank 12 polymerize when the aqueous solution is subjected to concentration in the evaporator to form higher molecular weight and higher boiling compounds that do not necessarily act as placticizers when they are recombined with the extracted solids.

The nature and objects of the invention are further illustrated by the results of laboratory and pilot plant tests. The first series of tests illustrates that the density of the fluidized bed in a pilot plant gasifier similar to the one depicted in FIG. 1 increases as the laboratory swelling index of the feed coal decreases. The second series of tests illustrates that the laboratory swelling index can be maintained at a value below 1.0 by extracting a raw bituminous coal with a potassium hydroxide solution having a pH above 12.

In the first series of tests, Illinois No. 6 bituminous coal was sprayed with an aqueous solution of potassium hydroxide, and the wet coal was passed through a series of screw dryers in which the coal was dried by indirect contact with steam thereby impregnating the coal with the potassium hydroxide. The dry coal was then passed into a fluidized bed oxidation vessel in which it was contacted with a mixture of nitrogen and oxygen. The vessel was steam jacketed in order to control the temperature during oxidation. The oxidized, potassium hydroxide impregnated coal was then passed into a fluidized bed gasifier, similar to the one depicted in FIG. 1, in which it was contacted with a mixture of steam, hydrogen and carbon monoxide at a temperature of about 700° C. and at a pressure of about 1.86 MPa. For each run the density of the fluidized bed in the gasifier was determined by measuring the pressure drop across pressure taps in the gasifier bed. A small sample of each batch of oxidized, catalyst impregnated coal was placed in a quartz tube approximately 13.5 centimeters long and having an inside diameter of about 2 millimeters. The end of the tube was sealed by heating it in a high temperature flame. The oxidized coal was then subjected to rapid heating at high temperature and a pressure above 3.5 MPa by placing the quartz tube in a specially designed laboratory furnace maintained at a temperature of about 950° C. The tube was removed from the furnace after about 30 seconds and was allowed to cool. The height of the oxidized coal was then measured. The ratio of the height of the coal in the tube after heating to the height before heating was then calculated and is referred to as the laboratory swelling index. The results of this series of tests are set forth in FIG. 2.

Figure 2:
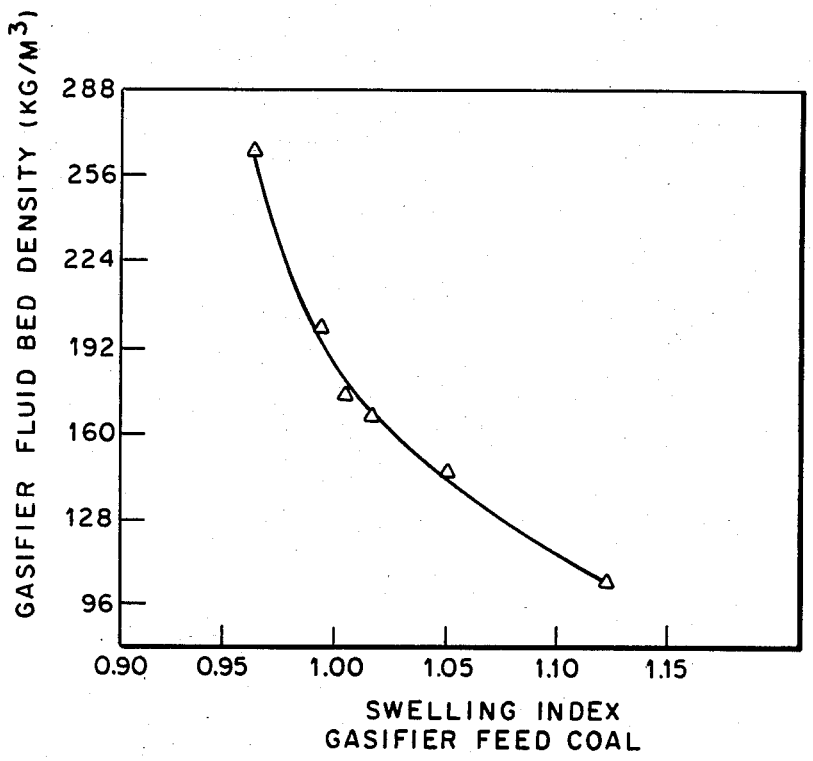
FIG. 2 is a plot indicating that the bed density in a fluidized bed gasification reactor fed with a bituminous coal impregnated with potassium hydroxide increases as the laboratory swelling index of the impregnated coal decreases.

As can be seen from FIG. 2, the swelling index of the various samples of oxidized, potassium hydroxide impregnated coal, as determined by the laboratory technique, appear to correlate well with the fluidized bed densities as measured in the pilot plant gasifier. As the swelling index increases, the fluidized bed density decreases. The data set forth in FIG. 2 clearly show that the laboratory measured swelling index is indicative of the fluidized bed density that is obtained when subjecting catalyst impregnated coal to gasification at relatively high pressures.

In the second series of tests, 30 grams of Illinois No. 6 bituminous coal were subjected to extraction in a Soxhlet extractor with water and with aqueous solutions of potassium hydroxide and potassium carbonate. The raw coal or coal impregnated with either potassium carbonate or potassium hydroxide was placed in the extraction thimble of the Soxhlet extractor while 400 millimeters of water was placed in the round bottom flask over which the extraction thimble was situated. The extraction was carried out by bringing the liquid in the flask to a boil and was allowed to continue for several hours. As the water vapors produced by boiling condensed, they were collected in the extraction thimble to form an aqueous alkali solution which was flushed from the thimble back into the round bottom flask when the solution reached a predetermined level in the thimble. The pH of the first thimble full of alkali solution was calculated. The following day the liquid in the flask and the extracted coal in the thimble were recombined, the liquid boiled off and the coal dried and weighed. The laboratory swelling index of each dry coal sample was then measured in the same manner as discussed in relation to the first series of tests. The results of this series of tests are set forth in Table I below.

TABLE I

SWELLING INDICES OF EXTRACTED COALS

| Sample | Initial pH | % Coal Extracted | Swelling Index |
|---|---|---|---|
| Raw Coal | 7.0 | <2.0 | 2.5–3.4 |
| 15 wt % $K_2CO_3$ on coal | 12.0 | 2.6 | 1.4 |
| 12 wt % KOH on coal | 14.0 | 5.7 | .92–.95 |

As can be seen from Table I, raw Illinois No. 6 bituminous coal has a rather high swell in index that ranges between 2.5 and 3.4. FIG. 2 shows that the density of the fluidized bed during high pressure gasification of raw coal would be very small. The data in Table I indicate that as more lower molecular weight organic material (bitumen) is extracted from the coal, the swelling index tends to decrease and, as indicated in FIG. 2, the gasifier fluid bed density increases. It is clear from the table that when a potassium hydroxide solution is used to extract the coal, much more low molecular weight organic material is extracted from the coal than when a potassium carbonate solution or plain water is used and the resultant swelling index of the extracted coal is below 1.0. Such a swelling index corresponds with a fluidized bed density of about 180 kg/m$^3$. It should be noted that although the experiments leading to the data in Table I were not carried out by directly slurrying raw coal in an aqueous solution of potassium carbonate or potassium hydroxide, such a solution was formed in the thimble of the Soxhlet extractor when the coal impregnated with potassium carbonate or potassium hydroxide was slurried in hot water. The data in Table I clearly show that the extraction of bitumens from coal using an aqueous solution having a pH greater than 12.0 will substantially reduce the swelling index of the coal which results in much higher fluidized bed densities during gasification.

It will be apparent from the foregoing that the invention provides a process which results in high fluidized bed densities when the coal or similar carbonaceous materials are gasified at elevated pressures. As a result, the number and size of the gasifiers required to carry out the gasification are reduced thereby lowering the overall cost of the process.

We claim:

1. A process for the fluidized bed gasification of carbonaceous solids, comprising:

introducing a slurry of carbonaceous solids to an extraction zone operated at atmospheric pressure to contact an aqueous solution at a pH above 13.5, which includes a water-soluble gasification catalyst comprising an alkali metal hydroxide or a mixture of an alkali metal hydroxide with at least one alkali metal salt, at a temperature of about 65° C. to about 110° C. for a sufficient length of time to extract bitumens from said solids into said aqueous solution;

removing water from said aqueous solution by flash drying a slurry effluent from said extraction zone to dry said carbonaceous solids, while simultaneously redepositing said extracted bitumens onto said carbonaceous solids and impregnating said carbonaceous solids with said catalyst; and gasifying said carbonaceous solids at an elevated pressure and temperature in a fluidized gasification zone, wherein the density of the fluidized bed in said gasification zone is maintained at a value above about 160 kg/m$^3$.

2. A process according to claim 1 in which said aqueous solution contains potassium hydroxide.

3. A process according to claim 1 in which said carbonaceous solids comprise coal.

4. A process according to claim 1 in which said carbonaceous solids are contacted with said aqueous solution at a temperature of between 90° C. and 105° C.

5. A process according to claim 1, wherein said at least one alkali metal salt is selected from the group consisting of carbonates and bi-carbonates.

6. A process for the fluidized bed gasification of carbonaceous solids, comprising:

introducing a slurry of carbonaceous solids to an extraction zone operated at atmospheric pressure to contact an aqueous solution at a pH above 13.5, which includes a water-soluble gasification catalyst comprising an alkali metal hydroxide or a mixture of an alkali metal hydroxide with at least one alkali metal salt, at a temperature of about 65° C. to about 110° C. for a sufficient length of time to extract bitumens from said solids into said aqueous solution;

separating said aqueous solution from said carbonaceous solids;

concentrating said separated aqueous solution by removing a portion of water therefrom;

recombining said concentrated aqueous solution with said carbonaceous solids;

drying said recombined concentrated aqueous solution and carbonaceous solids to simultaneously redeposit said bitumens onto the carbonaceous solids and impregnate said carbonaceous solids with said catalyst; and gasifying said carbonaceous solids at an elevated pressure and temperature in a fluidized gasification zone, wherein the density of the fluidized bed in said gasification zone is maintained at a value of above about 160 kg/m$^3$.

7. A process according to claim 6, in which said alkali metal hydroxide is potassium hydroxide.

8. A process according to claim 6, in which said carbonaceous solids comprise coal.

9. A process according to claim 6, wherein said carbonaceous solids are contacted with said aqueous solution at a temperature of between 90° C. and 105° C.

10. A process according to claim 6, wherein said at least one alkali metal salt is selected from the group consisting of carbonates and bi-carbonates.

* * * * *